US006614414B2

(12) United States Patent
De Haan et al.

(10) Patent No.: US 6,614,414 B2
(45) Date of Patent: Sep. 2, 2003

(54) METHOD OF AND UNIT FOR DISPLAYING AN IMAGE IN SUB-FIELDS

(75) Inventors: Gerard De Haan, Eindhoven (NL); Michiel Adriaanszoon Klompenhouwer, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 115 days.

(21) Appl. No.: 09/850,344

(22) Filed: May 7, 2001

(65) Prior Publication Data

US 2002/0015025 A1 Feb. 7, 2002

(30) Foreign Application Priority Data

May 9, 2000 (EP) ..... 00201655

(51) Int. Cl.[7] ..... G09G 3/28

(52) U.S. Cl. ..... 345/63; 345/60; 345/72; 345/690; 345/691

(58) Field of Search ..... 345/60, 63, 67, 345/72, 589, 596, 690–693

(56) References Cited

U.S. PATENT DOCUMENTS

| | | | | | |
|---|---|---|---|---|---|
| 5,757,343 | A | * | 5/1998 | Nagakubo | 345/63 |
| 5,841,413 | A | | 11/1998 | Zhu et al. | 345/63 |
| 6,025,818 | A | * | 2/2000 | Okano | 345/63 |
| 6,396,508 | B1 | * | 5/2002 | Noecker | 345/693 |
| 6,473,464 | B1 | * | 10/2002 | Weitbruch et al. | 375/240.26 |
| 6,476,875 | B2 | * | 11/2002 | Correa et al. | 348/607 |

* cited by examiner

*Primary Examiner*—Kent Chang
*Assistant Examiner*—Tom V. Sheng
(74) *Attorney, Agent, or Firm*—Edward W. Goodman

(57) ABSTRACT

A display unit displays an image on a display screen like a plasma display panel in a number of sub-fields. The display unit is arranged to control the intensity values of one of the color values of a pixel, in particular to control whether the highest weighted sub-field is switched on or off, by changing that color signal. The effect of this change on the luminance of the pixel is compensated by a change to one or both of the other color signals.

10 Claims, 2 Drawing Sheets

METHOD OF AND UNIT FOR DISPLAYING AN IMAGE IN SUB-FIELDS

BACKGROUND OF THE INVENTION

1. Field of the Invention

The invention relates to a display unit for displaying an image on a display device, wherein a plurality of periods, called sub-fields, are defined, each sub-field having a respective illumination level which is applied to the display device.

The invention further relates to an image display apparatus comprising such a display unit.

The invention further relates to method of displaying an image on a display device, wherein a plurality of periods, called sub-fields, are defined, each sub-field having a respective illumination level which is applied to the display device.

2. Description of the Related Art

U.S. Pat. No. 5,841,413 describes a plasma display panel driven in a plurality of sub-fields. A plasma display panel is made up of a number of cells that can be switched on and switched off. A cell corresponds with a pixel (picture element) of the image that is to be displayed on the panel. In the operation of the plasma display panel, three phases can be distinguished. The first phase is the erasure phase in which the memories of all cells of the panel are erased. The second phase is the addressing phase, in which the cells of the panel that are to be switched on are conditioned by setting appropriate voltages on their electrodes. The third phase is the sustain phase, in which sustain pulses are applied to the cells which cause the addressed cells to emit light for the duration of the sustain phase. The plasma display panel only emits light during this sustain phase. The three phases together are called a sub-field period or simply a sub-field. A single image, or frame, is displayed on the panel in a number of successive sub-field periods. A cell may be switched on for one or more of the sub-field periods. The light emitted by a cell in the sub-field periods in which it was switched on, is integrated in the eye of the viewer who perceives a corresponding intensity for that cell. In a particular sub-field period, the sustain phase is maintained for a particular time resulting in a particular illumination level of the activated cells. Typically, different sub-fields have a different duration of their sustain phase. A sub-field is given a coefficient of weight to express its contribution to the light emitted by the panel during the whole frame period. An example is a plasma display panel with 6 sub-fields having coefficients of weight of 1, 2, 4, 8, 16 and 32 respectively. By selecting the appropriate sub-fields in which a cell is switched on, 64 different intensity levels can be realized in displaying an image on this panel. The plasma display panel is then driven by using binary code words of 6 bits each, whereby a code word indicates the intensity level of a pixel in binary form.

In driving a plasma display panel, the frame period, i.e. the period between two successive images, is divided into a number of sub-field periods. During each of these sub-field periods, a cell may or may not be switched on and the integration over the sub-field periods results in a perceived intensity level of the pixel corresponding with this cell. Instead of displaying a pixel of an image as a single light flash that is proportional to its intensity level, on a plasma display panel, the pixel is displayed as a series of flashes shifted in time with respect to each other. This may cause artifacts if the eyes of the viewer move. Then it appears as if the light flashes do not originate from a single position and a blurring effect occurs. Furthermore, artifacts may occur in case the images show a moving object. The movement needs to be taken into account when displaying the object in a number of sub-fields. For each next sub-field, the object must be moved a little. Motion compensation techniques are used to calculate a corrected position for the sub-pixels in the sub-fields. In some circumstances, the motion compensation techniques are not fully reliable and may produce erroneous results, e.g. in an area of the image with little detail. The erroneous results lead to motion compensation where this should not be done. This gives so-called motion artifacts which are very visible.

An artifact is most noticeable if two neighboring pixels have a small difference in intensity level while for one of the pixels the sub-field with the largest coefficient of weight is on and for the other of the pixels this sub-field is off. In case of the example of the binary code above, the code word for one pixel has the most significant bit on and the code word for the other pixel has the most significant bit off. Any error in the calculated position of a sub-field, i.e., any motion artifact involving these pixels, will then give a relatively large artifact in the displayed image. The device described in U.S. Pat. No. 5,841,413 tries to mitigate these artifacts by restricting the code words that are used. This known device employs more sub-fields than necessary for realizing the required set of intensity values. The resulting set of code words for expressing the intensity value is redundant, i.e., for a given intensity value, more than one code word is available. From this redundant set, a subset is created whereby those code words are selected that give the least differences in the most significant bit for expressing a difference between the intensity values. This subset is created by searching the original set and determining what the effect on the artifacts may be for a difference between a given code word and each of the other code words.

SUMMARY OF THE INVENTION

It is an object of the invention to provide a display unit as described in the preamble with an improved reduction of artifacts. This object is achieved, according to the invention, in that the display unit comprises:

- an input for receiving respective input intensity values for sub-pixels of a particular pixel of the image,
- a control unit for:
  - comparing at least one of the input intensity values with at least one predetermined value,
  - conditionally modifying, on the basis of said comparing, the at least one of the input intensity values to a desired value, and
  - modifying at least a further one of the input intensity values to compensate the effect on a property of the pixel caused by the modifying, if any, of the at least one of the input intensity values,
- an output for sending respective output intensity values on the basis of the respective input intensity values potentially modified by the control unit, and
- a coding unit for coding the output intensity levels into combinations of sub-fields for the respective sub-pixels.

The display unit of the invention makes it possible to control the intensity value of a sub-pixel, i.e., to modify it from its original intensity value to a desired value, while the effect that such modification would have on a given property of the pixel of which this sub-pixel forms a part, is compensated by a change of the intensity value for one of the other sub-pixels of that pixel. According to the invention, a flexibility is created to change the intensity value of one of the sub-pixels while this property does not change, by also changing the intensity value of one of the other colors. This property can be the luminance of a pixel, the color of a pixel, or some other characteristic of the pixel realized by the contribution of the sub-pixels of the pixel.

Controlling the intensity value that is sent to the display device for a certain sub-pixel, gives direct control whether a specific sub-field for that sub-pixel is switched on or not. This makes it possible to avoid the above problems where two nearby pixels have almost the same intensity value while one has a high weighted sub-field on while the other has not. The intensity value for one of the pixels is controlled in such a way that both have the high weighted sub-field on or off, whichever is most suitable in the situation at hand. The display unit of the invention has the advantage that it can be applied to a scheme of sub-field weights where the number of possible intensity level is maximal in view of the number of sub-fields, while in the known device the number of sub-fields has been increased for a given number of intensity levels. An example of such a favorable scheme is the binary distribution, where the sub-fields weights are powers of 2.

In an embodiment of the display unit according to the invention as described above, the property of the pixel is the luminance of the pixel. The display unit of this embodiment makes it possible to control the intensity value of a color sub-pixel, i.e., to modify it from its original intensity value to a desired value, while the effect that such modification would have on the luminance of the pixel of which this color sub-pixel forms a part, is compensated by a change of the intensity value for one of the other sub-pixels of that pixel. According to the invention, a flexibility is created to change the intensity value of one of the colors while the luminance does not change, by also changing the intensity value of one of the other colors. This introduces a color error, but the human visual system is less sensitive to color changes than to luminance changes. It is reported that the smallest change in luminance a human can perceive is a change of 2%, while this is 5% for a change in color.

In an embodiment of the display unit according to the invention as described above, the input is arranged to receive the input intensity values for red, green and blue respectively and wherein the control unit is arranged to conditionally modify at least one of the 3 input intensity values to control its value and to modify at least one of the other 2 input intensity values to compensate the effect on the luminance according to the following equation:

$$0.3\Delta R+0.59\Delta G+0.11\Delta B=0$$

wherein ΔR is the modification of the red intensity value, ΔG is the modification of the green intensity value, and ΔB is the modification of the blue intensity value. The control unit of this embodiment compensates the effect on the luminance of the modification of the first color with a modification of a further color by applying a simple relation expressing the respective contributions of the colors to the perceived luminance.

In an embodiment of the display unit according to the invention as described above, the predetermined value corresponds with the illumination level of the highest weighted sub-field. This makes it possible to control the activation of the highest weighted sub-field of the corresponding color sub-pixel.

In an embodiment of the display unit according to the invention as described above, the control unit is arranged to modify the at least one of the input intensity values if it falls in a range with a lower boundary equal to the predetermined value minus $\Delta_{in}$ and an upper boundary equal to the predetermined value plus $\Delta_{in}$, $\Delta_{in}$ being equal to 5% of the maximum intensity level. By limiting the modification of the at least one of the input intensity values to this range, the compensating modification of the further one of the input intensity values is kept relatively small. This limits the color change of the pixel to a level that, in many practical situations, cannot be perceived by the human visual system.

In an embodiment of the display unit according to the invention as described above, the control unit is arranged to compare the modification of the further one of the input intensity values with a limit and, if it exceeds the limit, to disregard the modifications and to output the input intensity values as the output intensity values. The control unit in this embodiment avoids the generation of output intensity values of which the resulting color is so different from the original input intensity values, that it can easily be perceived. Rather than generating those output intensity values, the control unit outputs the original input intensity values. The control over the intensity value of the color sub-pixel is not carried out since it would result in an image that is perceivably worse than the original image.

It is a further object of the invention to provide method as described in the preamble realizing an improved reduction of artifacts. This object is achieved according to the invention in that the method comprises:

- an input step of receiving respective input intensity values for sub-pixels of a particular pixel of the image,
- a control step comprising:
  - comparing at least one of the input intensity values with a predetermined value,
  - conditionally modifying on the basis of said comparing the at least one of the input intensity values to a desired value, and
  - modifying at least a further one of the input intensity values to compensate the effect on a property of the pixel caused by the modifying, if any, of the at least one of the input intensity values,
- an output step of sending respective output intensity values on the basis of the respective input intensity values potentially modified by the control unit, and
- a coding step of coding the output intensity levels into combinations of sub-fields for the respective sub-pixels.

BRIEF DESCRIPTION OF THE DRAWINGS

The invention and its attendant advantages will be further elucidated with the aid of exemplary embodiments and the accompanying schematic drawings, wherein.

DESCRIPTION OF THE PREFERRED EMBODIMENTS

Figure 1:
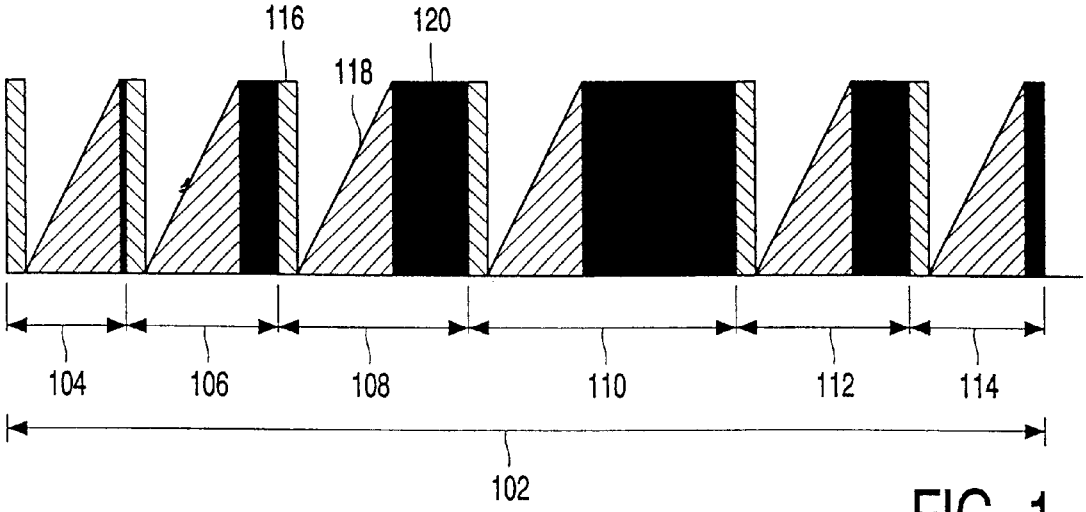
FIG. 1 schematically shows a field period with 6 sub-fields.

FIG. 1 schematically shows a field period with 6 sub-fields. The field period 102, also called the frame period, is the period in which a single image or frame is displayed on the display panel. In this example, the field period 102 consists of 6 sub-fields indicated with references 104, 106, 108, 110, 112 and 114. In a sub-field, a cell of the display panel may be switched on in order to produce an amount of light. Each sub-field starts with an erasure phase in which the memories of all cells are erased. The next phase in the sub-field is the addressing phase in which the cells that are to be switched on for emitting light in this particular sub-field are conditioned. Then, in a third phase of the sub-field, which is called the sustain phase, sustain pulses are applied to the cells. This causes the cells that have been addressed to emit light during the sustain phase. The organization of these phases is shown in FIG. 1, where time runs from left to right. For example sub-field 108 has an erasure phase 116, an addressing phase 118 and a sustain phase 120.

The perceived intensity of a pixel of a displayed image is determined by controlling during which of the sub-fields the cell corresponding to the pixel is switched on. The light emitted during the various sub-fields in which a cell is switched on is integrated in the eyes of the viewer, thus resulting in a certain intensity of the corresponding pixel. A sub-field has a coefficient of weight indicating its relative contribution to the emitted light. An example is a plasma display panel with 6 sub-fields having coefficients of weight of 1, 2, 4, 8, 16 and 32 respectively. By selecting the appropriate combination of sub-fields in which a cell is switched on, 64 different intensity levels can be realized in displaying an image on this panel. The plasma display panel is then driven by using binary code words of 6 bits each, whereby a code word indicates the intensity level of a pixel in binary form.

Figure 2:
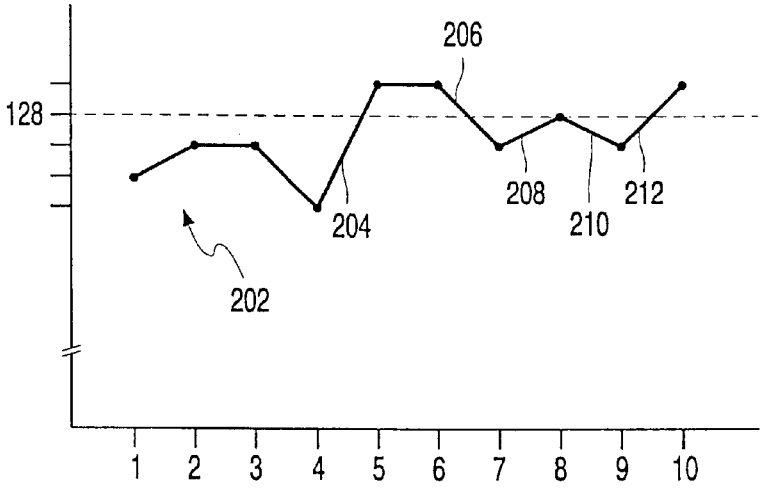
FIG. 2 shows the intensity levels of a series of pixels for a display device using 8 sub-fields.

FIG. 2 shows the intensity levels of a series of pixels for a display device using 8 sub-fields. The series of pixels can be the adjacent pixels on a horizontal or vertical line of the display. However, the series can also be the different intensity values over time of a single position on the display. Trace 202 indicates the intensity value expressed as a code word representing the combination of sub-fields as described above. The trace shows, for example, pixel 1 having an intensity of 126 and pixel 10 having an intensity of 129. The following Table I shows, for this series of pixels, in which sub-fields the corresponding cell or cells of the display are switched on. The sub-fields SF1, . . . , SF8 have coefficients of weight of 1, 2, 4, 8, 16, 32, 64 and 128 respectively.

TABLE I

Combinations of sub-fields for intensity levels of the series of pixels

| | intensity | SF1 | SF2 | SF3 | SF4 | SF5 | SF6 | SF7 | SF8 |
|---|---|---|---|---|---|---|---|---|---|
| 1 | 126 | | x | x | x | x | x | x | |
| 2 | 127 | x | x | x | x | x | x | x | |
| 3 | 127 | x | x | x | x | x | x | x | |
| 4 | 125 | x | | x | x | x | x | x | |
| 5 | 129 | x | | | | | | | x |
| 6 | 129 | x | | | | | | | x |
| 7 | 127 | x | x | x | x | x | x | x | |
| 8 | 128 | | | | | | | | x |
| 9 | 127 | x | x | x | x | x | x | x | |
| 10 | 129 | x | | | | | | | x |

This table shows, for example, that, for pixel 2 with an intensity level of 127, all sub-fields but sub-field SF8 are to be used.

A transition from one intensity to a different intensity is realized by using a different combination of sub-fields. For some transitions, a small change in intensity has to be realized by a change in sub-field SF8, the sub-field generating the largest amount of light. These are transitions 204, 206, 208, 210 and 212 in FIG. 2. Artifacts related to the pixels involved in such transitions are more noticeable than others since they concern the sub-fields producing a relatively large part of the light.

Figure 3:
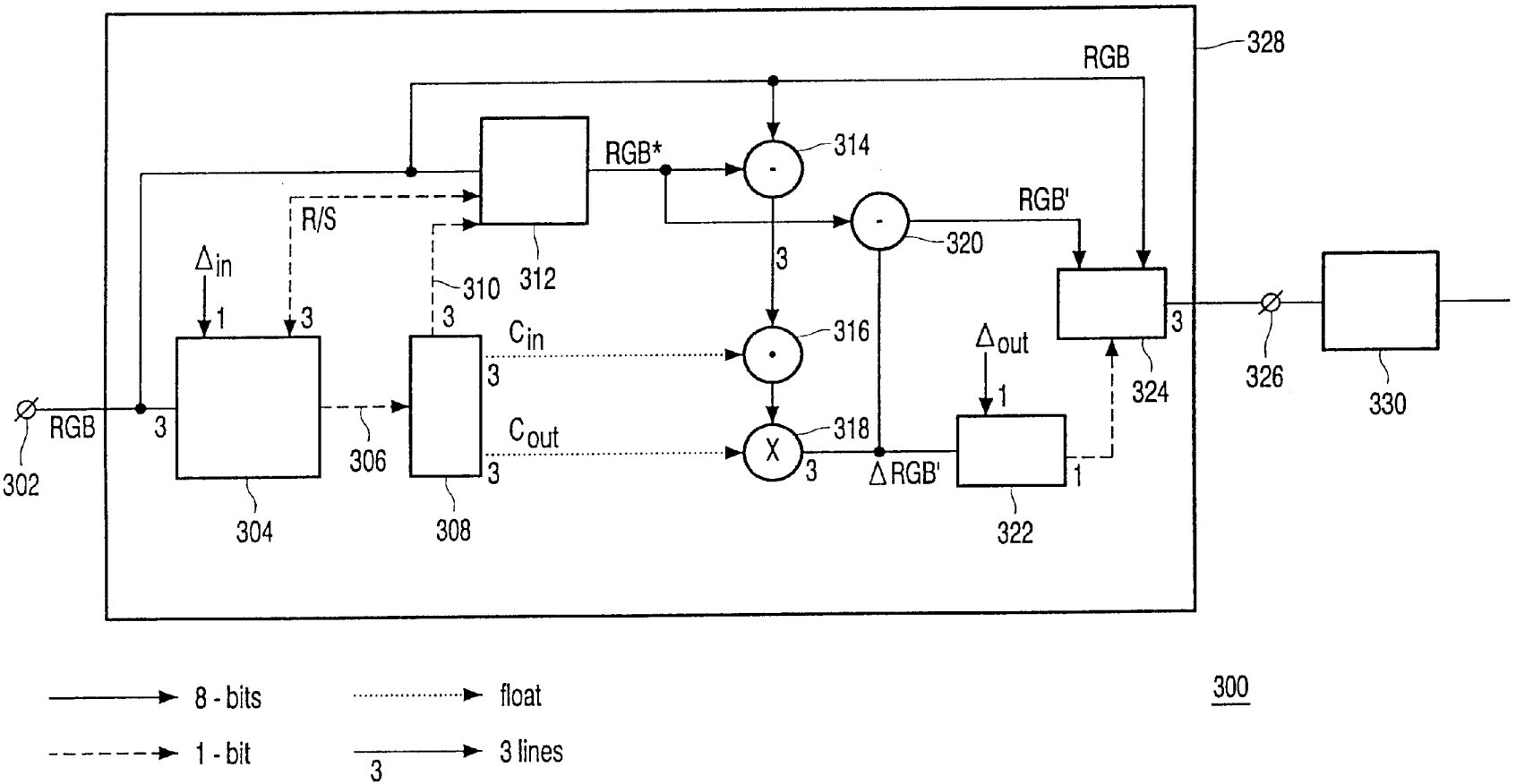
FIG. 3 schematically shows a display unit according to the invention.

FIG. 3 schematically shows a display unit according to the invention. The display unit 300 has an input 302 to receive the RGB values, i.e. the intensity values for the red, the green and the blue color sub-pixel, respectively. The overall function of display unit in this embodiment is to control, to a certain extent, whether the most significant bit (MSB) of the RGB values sent to the display device are switched on or off. There is a 3-bit-wide indication signal R/S that expresses the desired setting for each of the 3 color. If R/S equals 1, the display unit tries to set the MSB of the corresponding color and if necessary increases that signal by a small amount to realize this. The RGB values are fed to a zone check block 304 that checks whether one or more of the colors is close to the MSB. To this end, a zone is defined around the intensity level corresponding with the MSB. This zone has a lower range from $127-\Delta_{in}$ up to and including 127 and an upper range from and including 128 to and not including $128+\Delta_{in}$. The parameter $\Delta_{in}$ is input to the zone check block and controls what change of intensity value is allowable. In practice, for this embodiment of 8 bits the value of $\Delta_{in}$ can be 10 to 15. Furthermore, the indication signal R/S is input for the zone check block to identify the range in which the intensity value may reside to decide on the change. If R/S equals 1, it is checked whether the intensity value falls in the lower range, and if so, a zone signal 306 is set to 1. If R/S equals to 0, it is checked whether the intensity value falls in the upper range, and if so, the zone signal is set to 1. The zone signal 306 is a 3-bit-wide signal used for addressing a look-up table 308 on which further processing of the RGB signal is based.

A change signal 310 is derived from the look-up table 308. This is a 3-bit-wide signal indicating which of the color values need to be modified for controlling the MSB. In most cases, the change signal is the same as the control signal meaning that if an input intensity value is close to the MSB, i.e., in the particular range, it will be set to the desired value indicated by the R/S signal. Only if all three color intensity values are close to the MSB, it is indicated that the green and the red values are to be changed for controlling their MSB. So these color values are given priority over the blue value. The change signal 310 and the indication signal R/S together determine how the Reset/Set MSB block 312 modifies the RGB input signal into a modified RGB* signal. This modification is done according to the table below, wherein X indicates one of the RGB values and X* the corresponding component after the modification.

TABLE II

Color component after MSB control

| Change | R/S | X* |
|---|---|---|
| 0 | 0 | X |
| 0 | 1 | X |
| 1 | 0 | 127 |
| 1 | 1 | 128 |

In words: when the change signal is 0, the output color component X* remains the same is the input color component X. When the change signal is 1, the output color component X* gets such a value that its MSB is set to the same value as the indication signal R/S.

The luminance of the pixel to which the RGB input relates is kept constant by compensating any changes due to the MSB control. The amount of compensation needed in each component depends on which components have been changed. When two components have been changed, there is only one component left for compensation, and the constraint of constant luminance directly determines the amount of compensation. For example, when R and B are changed by the Reset/Set MSB block ($\Delta R^*$ and $\Delta B^*$) and compensated by G, then this compensating change $\Delta G'$ is determined from the following equation:

$$0.3\Delta R^*+0.59\Delta G'+0.11\Delta B^*=0 \Leftrightarrow \Delta G'=-1/0.59\ (0.3\Delta R^*+0.11\Delta B^*) \quad (1)$$

The changes $\Delta RGB^*$ due to MSB control are obtained by subtracting the changed RGB* from the original RGB as indicated by operation 314 in FIG. 3. When only one component is changed due to the MSB control, this can be compensated by any valid combination of the other two components. In view of the sensitivity for the various color components of the human visual system, it has been chosen to compensate a change in B due to the MSB control only with a change in G and also to compensate a change in R due to the MSB control only with a change in G. A change in G due to MSB control is compensated by changes in R and B, while applying the following ratio for the changes:

$$\Delta R'=2.7\Delta B' \quad (2)$$

The changes to the color components due to MSB control and the compensating changes to the color components are specified in the look-up table 308, which has the contents as shown in Table III below.

TABLE III

Lookup table to determine compensating changes

| zone | | | change | | | $C_{in}$ | | | $C_{out}$ | | |
|---|---|---|---|---|---|---|---|---|---|---|---|
| R | G | B | R | G | B | R | G | B | R | G | B |
| 0 | 0 | 0 | 0 | 0 | 0 | 0 | 0 | 0 | 0 | 0 | 0 |
| 0 | 0 | 1 | 0 | 0 | 1 | 0 | 0 | 0.11 | 0 | 1.69 | 0 |
| 0 | 1 | 0 | 0 | 1 | 0 | 0 | 0.59 | 0 | 1.73 | 0 | 0.64 |
| 0 | 1 | 1 | 0 | 1 | 1 | 0 | 0.59 | 0.11 | 3.33 | 0 | 0 |
| 1 | 0 | 0 | 1 | 0 | 0 | 0.3 | 0 | 0 | 0 | 1.69 | 0 |
| 1 | 0 | 1 | 1 | 0 | 1 | 0.3 | 0 | 0.11 | 0 | 1.69 | 0 |
| 1 | 1 | 0 | 1 | 1 | 0 | 0.3 | 0.59 | 0 | 0 | 0 | 9.09 |
| 1 | 1 | 1 | 1 | 1 | 0 | 0.3 | 0.59 | 0 | 0 | 0 | 9.09 |

For each X of the three color components a compensating change $\Delta X'$ is calculated using the coefficient of the lookup table and by applying the following equation:

$$\Delta X' = C_{out,X}[\Delta R^* \Delta G^* \Delta B^*]\begin{bmatrix} C_{\text{in},R} \\ C_{\text{in},G} \\ C_{\text{in},B} \end{bmatrix} \quad (3)$$

wherein, $C_{in,R}$ is the coefficient weighing the change due to MSB control of the red value, $C_{in,G}$ is the coefficient weighing the change due to MSB control of the green value, $C_{in,B}$ is the coefficient weighing the change due to MSB control of the blue value, $\Delta R^*$ is the change of the red value due to MSB control, $\Delta G^*$ is the change of the green value due to MSB control, $\Delta B^*$ is the change of the blue value due to MSB control, and $C_{out,X}$ is the coefficient weighing the compensating change for the component X.

As indicated above, the changes are calculated for R, G and B resulting in the compensation signal $\Delta RGB'$. The application of equation (3) is indicated in FIG. 3 by operations 316 and 318. The compensation signal $\Delta RGB'$ is subtracted from the signal RGB* containing the changes due to MSB control in operation 320. This results in the signal RGB' containing both the changes due to MSB control and the compensating changes. Optionally, the changes in the compensation signal $\Delta RGB'$ may be checked against a limit to avoid that too large changes are generated by the control unit. To this end, each of the changes in the compensation signal $\Delta RGB'$ is compared with a limit $\Delta_{out}$ in block 322. The value for the limit $\Delta_{out}$ can be chosen the same as the value for the input limit $\Delta_{in}$, however, a different value may be chosen to better control the color distortions. If none of the changes exceeds the limit $\Delta_{out}$, then a selector 324 is controlled to output the RGB' signal as the output signal on output 326, otherwise, the selector 324 is controlled to output the original RGB signal as the output signal and to disregard all changes. This avoids that the quality of the image becomes worse than the original input image due to large color distortions from the compensating change. The various elements potentially changing the signal are structured into a control unit 328 as shown in FIG. 3.

The output RGB signal from output 326 is fed to a coding unit 330 for coding the signal into the appropriate combinations of sub-fields that are to be switched on. This coding may involve further processing to improve the resulting image. This further processing may be motion compensation to improve the display of moving objects on the display device.

The display device described above allows a level of control over the MSB. This can be exploited by avoiding transitions of the MSB between neighboring pixels. This can be realized by holding to a state of the MSB as long as possible and to only switch to the other state when this has cannot be avoided. The MSB is set as long as the intensity value remains above $128-\Delta_{in}$. When the intensity value drops below $128-\Delta_{in}$, the MSB is reset, only to be set again when the value exceeds $127+\Delta_{in}$. This causes a hysteresis-like effect when displaying the stream of pixels, which results in a reduction of transitions of the MSB. The above technique is particularly advantageous in image areas with noise around the MSB level. Other schemes for deciding whether or not the MSB should be set are possible and can exploit the ability of the display unit of the invention.

The embodiment described above shows the control of the MSB, i.e., of the sub-field with the highest weight. However, it is also possible to control the MSB-1, i.e., the sub-field with the highest but one weight, in a similar way. Furthermore, the invention has been explained using a binary distribution of the sub-field weights. However, it can easily be applied to other distributions as well since it merely requires a zone check around the level of the sub-field that needs to be controlled. Whether this belongs to a binary distribution or not is actually irrelevant for application of the invention.

Figure 4:
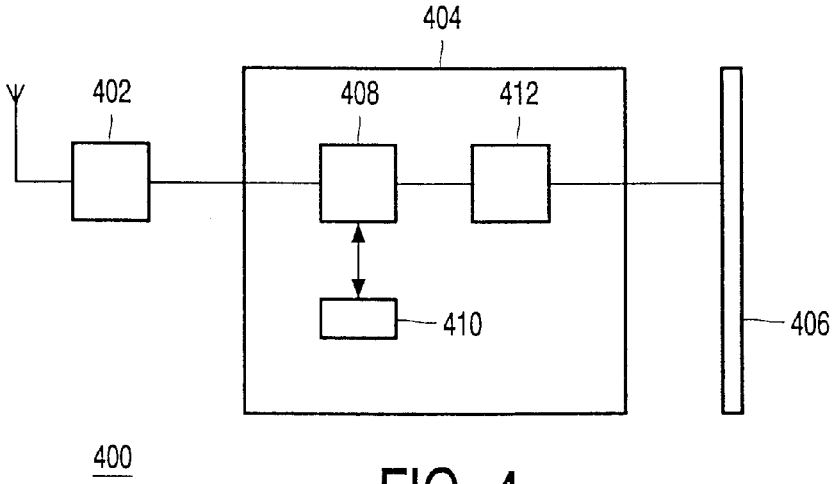
FIG. 4 shows the most important elements of an image display apparatus according to the invention.

FIG. 4 shows the most important elements of an image display apparatus according to the invention. The image display apparatus 400 has a receiving means 402 for receiving a signal representing the image to be displayed. This signal may be a broadcast signal received via an antenna or cable but may also be a signal from a storage device, like a VCR (Video Cassette Recorder). The image display apparatus 400 further has a display unit 404 for processing the image and a display device 406 for displaying the processed image. The display device 406 is of a type that is driven in sub-fields. The display unit has a selection means 408 for selecting the appropriate combination of sub-fields for each of the pixels of the image. The selection means uses a memory 410 where one or more pixels and their combinations of sub-fields are for carrying out those alternative methods described above that require storing one or more pixels. Furthermore, the display unit has a sending means 412 for sending the representations of sub-field combinations of the pixels to the display device 406.

It should be noted that the above-mentioned embodiments illustrate rather than limit the invention and that those skilled in the art will be able to design many alternative embodiments without departing from the scope of the appended claims. The word 'comprising' does not exclude the presence of elements or steps other than those listed in a claim. The word "a" or "an" preceding an element does not exclude the presence of a plurality of such elements. The invention can be implemented by means of hardware comprising several distinct elements and by means of a suitably programmed computer. In the unit claims enumerating several means, several of these means can be embodied by one and the same item of hardware.

What is claimed is:

1. A display unit for displaying an image on a display device, wherein a plurality of sub-fields are defined, each sub-field having a respective illumination level which is applied to the display device, the display unit comprising:

an input for receiving respective input intensity values for sub-pixels of a particular pixel of the image;

a control unit for comparing at least one of the input intensity values with a predetermined value, conditionally modifying, on the basis of said comparing, the at least one of the input intensity values to a desired value, and modifying at least a further one of the input intensity values to compensate the effect on a property of the pixel caused by the modifying, if any, of the at least one of the input intensity values;

an output for sending respective output intensity values on the basis of the respective input intensity values potentially modified by the control unit; and a coding unit for coding the output intensity levels into combinations of sub-fields for the respective sub-pixels.

2. The display unit as claimed in claim 1, wherein the property of the pixel is the luminance of the pixel.

3. The display unit as claimed in claim 1, wherein the input receives the input intensity values for red, green and blue, respectively, and wherein the control unit conditionally modifies at least one of the 3 input intensity values to control its value, and modifies at least one of the other 2 input intensity values to compensate the effect on the luminance according to the equation:

$$0.3\Delta R+0.59\Delta G+0.11\Delta B=0$$

wherein:

ΔR is the modification of the red intensity value,

ΔG is the modification of the green intensity value, and

ΔB is the modification of the blue intensity value.

4. The display unit as claimed in claim 1, wherein the predetermined value corresponds with the illumination level of the highest weighted sub-field.

5. The display unit as claimed in claim 1, wherein the control unit modifies the at least one of the input intensity values if it falls in a range with a lower boundary equal to the predetermined value minus $\Delta_{in}$ and an upper boundary equal to the predetermined value plus $\Delta_{in}$, $\Delta_{in}$ being equal to 5% of the maximum intensity level.

6. The display unit as claimed in claim 1, wherein the control unit compares the modification of the further one of the input intensity values with a limit and, if the further one of the input intensity values exceeds the limit, the control unit disregards the modifications and outputs the input intensity values as the output intensity values.

7. An image display apparatus for displaying an image, comprising:

receiving means for receiving a signal representing the image;

a display unit as claimed in any one of the claims 1–6; and a display device for displaying the image.

8. A method of displaying an image on a display device, wherein a plurality of sub-fields are defined, each sub-field having a respective illumination level which is applied to the display device, the method comprising the steps:

receiving respective input intensity values for sub-pixels of a particular pixel of the image;

comparing at least one of the input intensity values with at least one predetermined value;

conditionally modifying, on the basis of said comparing the at least one of the input intensity values to a desired value;

modifying at least a further one of the input intensity values to compensate the effect on a property of the pixel caused by the modifying, if any, of the at least one of the input intensity values;

outputting respective output intensity values on the basis of the respective input intensity values potentially modified by the control unit; and coding the output intensity levels into combinations of sub-fields for the respective sub-pixels.

9. The method as claimed in claim 8, wherein the input intensity values relate to red, green and blue, respectively, and wherein at least one of the 3 input intensity values is modified to control its value, and at least one of the other 2 input intensity values is modified to compensate the effect on the luminance according to the following equation:

$$0.3\Delta R+0.59\Delta G+0.1\Delta B=0$$

wherein:

ΔR is the modification of the red intensity value,

ΔG is the modification of the green intensity value, and

ΔB is the modification of the blue intensity value.

10. The method as claimed in claim 8, wherein the predetermined value corresponds with the illumination level of the highest weighted sub-field.

* * * * *